US010066790B2

(12) United States Patent
Kim et al.

(10) Patent No.: US 10,066,790 B2
(45) Date of Patent: Sep. 4, 2018

(54) FLUORESCENT LAMP-TYPE LED LIGHTING DEVICE

(71) Applicant: KMW Inc., Hwaseong, Gyeonggi-Do (KR)

(72) Inventors: Duk-Yong Kim, Gyeonggi-Do (KR); Min-Soo Kim, Gyeonggi-Do (KR); Joon-Hong Park, Gyeonggi-Do (KR); Sung-Hoon Yoon, Gyeonggi-Do (KR)

(73) Assignee: GIGATERA INC., Hwaseong (KR)

( * ) Notice: Subject to any disclaimer, the term of this patent is extended or adjusted under 35 U.S.C. 154(b) by 152 days.

(21) Appl. No.: 14/749,186

(22) Filed: Jun. 24, 2015

(65) Prior Publication Data

US 2015/0292683 A1 Oct. 15, 2015

Related U.S. Application Data

(63) Continuation of application No. PCT/KR2013/012128, filed on Dec. 24, 2013.

(30) Foreign Application Priority Data

Dec. 24, 2012 (KR) ..... 10-2012-0151847
Jun. 25, 2013 (KR) ..... 10-2013-0073102

(51) Int. Cl.
*F21S 4/00* (2016.01)
*F21K 99/00* (2016.01)
(Continued)

(52) U.S. Cl.
CPC ..... *F21K 9/175* (2013.01); *F21K 9/27* (2016.08); *F21K 9/62* (2016.08); *F21S 8/04* (2013.01);
(Continued)

(58) Field of Classification Search
CPC .... F21K 9/175; F21K 9/27; F21S 8/04; F21V 3/02; F21V 13/02; F21V 21/00; F21V 23/02; F21V 23/06
(Continued)

(56) References Cited

U.S. PATENT DOCUMENTS 3,209,142 A 9/1965 Michel et al.
5,025,355 A 6/1991 Harwood
(Continued)

FOREIGN PATENT DOCUMENTS

CN 102788282 A 11/2012
DE 10105622 A1 8/2002
(Continued)

OTHER PUBLICATIONS

EP Search Report dated Jul. 13, 2016 in the corresponding European Patent Application No. 13867637.4.

*Primary Examiner* — Anh Mai
*Assistant Examiner* — Meghan Ulanday
(74) *Attorney, Agent, or Firm* — Mintz Levin Cohn Ferris Glovsky and Popeo, P.C.; Kongsik Kim; Jhongwoo Jay Peck

(57) ABSTRACT

The present invention relates to a fluorescent lamp-type LED lighting device including: a case part formed to be elongated in one direction and having an open bottom surface which provides a reflection space on the inner side; a cover part provided on the bottom surface of the case part so that the light which is reflected and diffused in the case part is emitted; and multiple LEDs which emit the light from the cover part and the inner side of the case part such that the light is reflected and diffused on the inner side of the case part. According to the present invention, the LED light is emitted toward an indoor ceiling side, the reflection space is provided so as to reflect and diffuse the emitted LED light,
(Continued)

and the light is emitted through a bottom surface part. Accordingly, no additional diffusion plate for surface emission is used and thus optical efficiency can be increased.

12 Claims, 9 Drawing Sheets

(51) Int. Cl.

| | |
|---|---|
| ***F21V 3/02*** | (2006.01) |
| ***F21V 13/02*** | (2006.01) |
| ***F21V 21/00*** | (2006.01) |
| ***F21S 8/04*** | (2006.01) |
| ***F21V 23/02*** | (2006.01) |
| ***F21V 23/06*** | (2006.01) |
| ***F21K 9/27*** | (2016.01) |
| ***F21K 9/62*** | (2016.01) |
| *F21S 8/06* | (2006.01) |
| *F21V 7/00* | (2006.01) |
| *F21K 9/20* | (2016.01) |
| *F21Y 103/10* | (2016.01) |
| *F21Y 115/10* | (2016.01) |

(52) U.S. Cl.
CPC ..... *F21V 3/02* (2013.01); *F21V 13/02* (2013.01); *F21V 21/00* (2013.01); *F21V 23/02* (2013.01); *F21V 23/06* (2013.01); *F21K 9/20* (2016.08); *F21S 8/06* (2013.01); *F21V 7/005* (2013.01); *F21V 7/0016* (2013.01); *F21Y 2103/10* (2016.08); *F21Y 2115/10* (2016.08)

(58) Field of Classification Search
USPC ..... 362/223
See application file for complete search history.

(56) References Cited

U.S. PATENT DOCUMENTS

| | | | | |
|---|---|---|---|---|
| 8,210,724 | B2 * | 7/2012 | Ying | B60Q 3/005 362/479 |
| 2004/0104659 | A1 * | 6/2004 | Holzer | F21V 19/008 313/318.01 |
| 2009/0159919 | A1 | 6/2009 | Simon et al. | |
| 2009/0316383 | A1 | 12/2009 | Son et al. | |
| 2010/0220469 | A1 | 9/2010 | Ivey et al. | |
| 2013/0119896 | A1 * | 5/2013 | Fukano | H01R 13/7175 315/312 |
| 2013/0208495 | A1 * | 8/2013 | Dau | F21V 7/0008 362/551 |
| 2013/0258656 | A1 | 10/2013 | Chin | |

FOREIGN PATENT DOCUMENTS

| | | | |
|---|---|---|---|
| JP | 2008-287994 | A | 11/2008 |
| JP | 2009-252562 | A | 10/2009 |
| JP | 2010-129427 | A | 6/2010 |
| JP | 2011-210594 | A | 10/2011 |
| KR | 20-0380420 | Y1 | 3/2005 |
| KR | 10-2010-0114761 | A | 10/2010 |
| KR | 10-0998980 | B1 | 12/2010 |
| KR | 10-2011-0012878 | A | 2/2011 |
| KR | 10-2011-0080210 | A | 7/2011 |
| WO | WO-2008-146229 | A2 | 12/2008 |
| WO | WO-2012-002135 | A1 | 1/2012 |

* cited by examiner

FLUORESCENT LAMP-TYPE LED LIGHTING DEVICE

CROSS REFERENCE TO RELATED APPLICATIONS

This application is a continuation of International Application No. PCT/KR2013/012128 filed on Dec. 24, 2013, which claims priority to Korean Application No. 10-2012-0151847 filed on Dec. 24, 2012, and Korean Application No. 10-2013-0073102 filed on Jun. 25, 2013, which applications are incorporated herein by reference.

TECHNICAL FIELD

The present disclosure relates to an LED lighting device and, more particularly, to a fluorescent lamp type LED lighting device having improved expandability and versatility.

BACKGROUND ART

Generally, an indoor lighting device using an LED can be roughly classified into a bulb-type lighting device which is to replace a socket-type light bulb and a surface lighting device which is to replace a fluorescent light.

Among them, most surface lighting devices use a diffusion plate having a predetermined area as a cover, and an example thereof is disclosed in Korean Patent No. 10-0998980 (registered on Dec. 1, 2010). In FIG. 4 which is a representative drawing of the registered patent, a substrate on which a plurality of LEDs are arranged to upwardly emit light is packaged, and a diffusion layer of one or more layers is included on the substrate, so that light emitted from the plurality of LEDs is diffused, thereby illuminating the entirety of a surface having a specific size at a constant illuminance.

The above-described configuration, which is commonly used as a general surface lighting device, has a problem in that the diffusion plate prevents light from being intensively emitted from a part thereof, so that glare is prevented from being generated, but light efficiency is reduced due to a large amount of optical losses.

For this reason, there is a problem in that, since a larger number of LEDs than necessary should be used in order to provide a surface light source having a sufficient illuminance, an advantage of a LED light, which corresponds to low power consumption, can be weakened, and since it is not easy to treat emitted heat, the lifespan of the LED can be shortened due to the heat.

In addition, in a case of a surface light emitting device illustrated in FIG. 4 of the Patent, there is a problem in that the design of a case should necessarily be changed when the lighting device is changed from a 40 W type to a 20 W type under an assumption that LEDs chip having the same output are used.

In this case, when 20 W LEDs are used, the number of LEDs is decreased to the half number of 40 W LEDs, so that an interval between the LEDs is widened. As a result, a bright area and a dark area are generated on the diffusion plate directly under a light emitting surface of the LEDs, so that illumination unevenness of a light emitting surface is generated.

There is a problem in that, in order to resolve such illumination unevenness, a design change should be made in which a distance between the LED and the diffusion plate is adjusted to be wider, or a light emitting part should be actually manufactured in a half size and a reflector, etc. should be employed as the other half part.

In addition, since the fluorescent lamp type LED lighting devices according to the related art have a light-emitting surface facing the bottom surface, and have a limited light emitting angle with regard to the light-emitting surface, a dark zone darker than surroundings thereof exists on a ceiling near the lighting devices.

There is a problem in that the forming of such a dark zone causes a feeling that it is darker than an actual indoor brightness, and the illumination unevenness causes a disorganized and distracted indoor atmosphere.

SUMMARY

The present disclosure has been made to solve the above-described problem and, an aspect of the present disclosure is to provide a fluorescent lamp type LED lighting device which can perform surface emitting even while adopting a simple structure.

Further, another aspect of the present disclosure is to provide a fluorescent lamp type LED lighting device which can be integrally formed with or separated from a power supply unit, and can be applied to the existing fluorescent lighting fixture.

In addition, another aspect of the present disclosure is to provide a fluorescent lamp type LED lighting device which can be applied to an embedded type or pendant type lighting fixture regardless of a distance between a ceiling and the same, and particularly, can prevent a dark zone from being formed on the ceiling.

Further, another aspect of the present disclosure is to provide an LED lighting device which can be easily replaced with an indoor fluorescent lighting device, thereby achieving excellent versatility and excellent expandability to satisfy required illuminance at an installation location.

A fluorescent lamp type lighting device according to the present disclosure includes: a case part which is formed to be elongated in one direction and has a reflection space formed therein, wherein the bottom surface of the case part is open; a cover part which is provided on the bottom surface of the case part and through which light, reflected and diffused from the interior of the case part, is emitted; and a plurality of LEDs which emit light from the interior of the cover part and the case part to reflect and diffuse the light inside the case part.

DETAILED DESCRIPTION

Hereinafter, a fluorescent lamp type LED lighting device according to an exemplary embodiment of the present disclosure will be described in detail with reference to the accompanying drawings.

Figure 1:
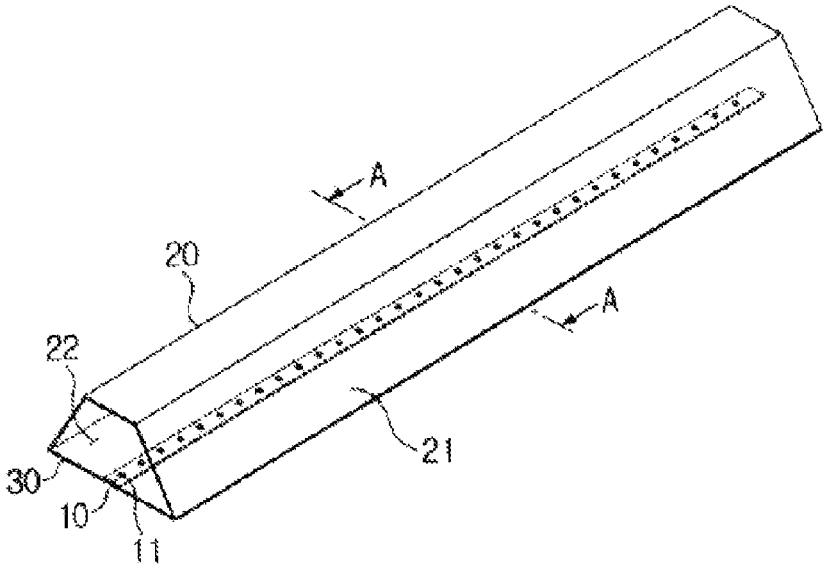
FIG. 1 is a perspective view illustrating a fluorescent lamp type LED lighting device according to an exemplary embodiment of the present disclosure.
Figure 2:
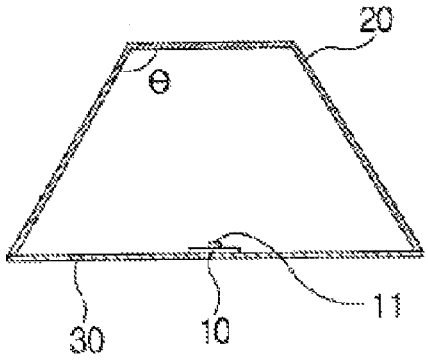
FIG. 2 is a sectional view taken along line A-A in FIG. 1.
Figure 3:
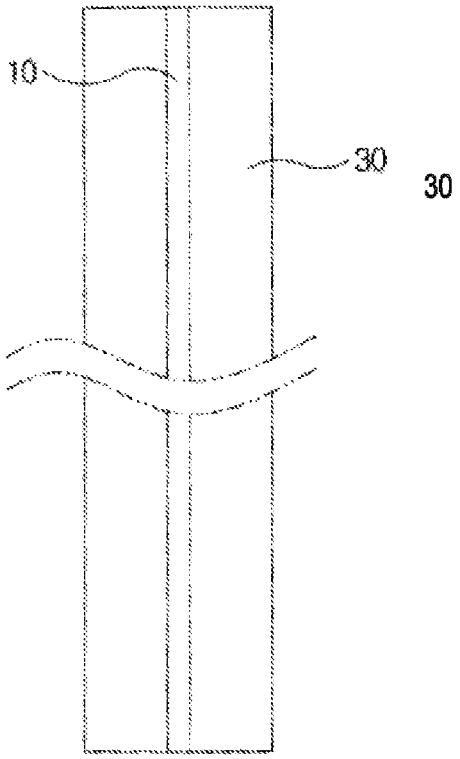
FIG. 3 is a bottom view of FIG. 1.

FIG. 1 is a perspective view illustrating a fluorescent lamp type LED lighting device according to an exemplary embodiment of the present disclosure, FIG. 2 is a sectional view taken along line A-A in FIG. 1, and FIG. 3 is a bottom view of FIG. 1.

Referring to FIGS. 1 to 3, a fluorescent lamp type LED lighting device according to an exemplary embodiment of the present disclosure includes: a case part 20 which has a reflection space of light formed therein and is formed to be elongated in one direction; a cover part 30 coupled to the bottom surface of the case part 20; and a substrate 10 which is provided above the cover part 30 to be elongated along the lengthwise direction of the case part 20 and has a plurality of LEDs 11 mounted thereto.

The case part 20 includes a side reflection surface 21, of which the central portion is flat and opposite surfaces in the lengthwise direction are curved downwardly, and a finishing reflection surface 22 formed in the width direction. The finishing reflection surface 22 may be integrally formed with the case part 20 or may be joined or coupled to the case part 20.

Hereinafter, the structure and operation of the fluorescent lamp type LED lighting device according to an exemplary embodiment of the present disclosure constructed as described above will be described in detail.

First, the case part 20 has a box-shaped structure, the lower side of which is open, and particularly, has a shape, which is to be elongated in one direction, in order to replace the existing fluorescent light.

The case part 20 may be made of a resin material which can reflect light or may have a structure in which a reflection sheet is attached to the inside of a resin material. Before the case part 20 is manufactured, the side reflection surface 21 is formed by attaching a reflection sheet and then performing bending, so that the reflection sheet can be attached more easily.

The transparent cover part 30 can be joined or coupled to the bottom surface of the case part 20. A material which does not diffuse light but transmits light may be used as the cover 30. Even when such a transparent cover 30 is used, since light is reflected inside the reflection space provided in the case part 20 and is then emitted through the cover part 30, surface emitting in which a glare phenomenon is remarkably reduced can be achieved.

Therefore, light efficiency can be improved, and a light having the same illuminance as that of the related art can be provided.

The cover 30 may be completely transparent, and a diffusion plate, by which slight diffusion can be performed, can be used as the cover 30.

The substrate 10 is attached to the upper surface of the cover 30, that is, a surface facing the inner upper portion of the case part 20. The substrate 10 has a plurality of LEDs 11 mounted thereon, and is formed to be elongated in the lengthwise direction of the cover 30.

In particular, as illustrated in FIG. 3, it can be identified that the substrate 10 is provided at the central portion of the cover part 30 and divides the cover part 30 into two parts in the width direction. This structure corresponds to a shape in which two fluorescent lights are installed side by side and seems similar to the shape of the existing fluorescent light, so that even users who are visually sensitive can be satisfied without particular visual repulsion.

The LEDs 11 do not emit light toward the bottom surface but emits light toward the upper side corresponding to a ceiling-side, in an installed state. The emitted light is variously reflected and diffused inside the case part 20, thereby achieving surface emitting through the cover part 30.

At this time, an interior angle θ between the side reflection surface 21 of the case part 20 and the upper flat surface is an obtuse angle which is larger than 90 degrees and smaller than 180 degrees, and a corner therebetween is not rounded but is a bent groove which is surely bent.

In a case of a rounded corner, light is concentrated inside the same, so that contrast may be generated.

In this way, the present disclosure diffuses light in a space and then performs surface emitting through the cover part 30, thereby performing lighting. Therefore, since light efficiency is not reduced for the diffusion, the light efficiency can be improved.

Figure 4:
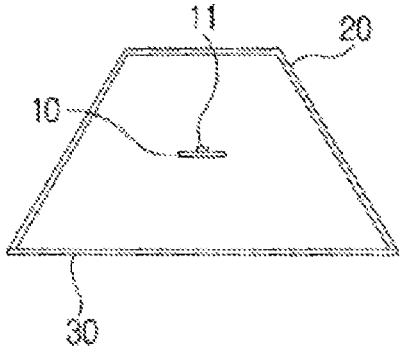
FIGS. 4 and 5 are sectional views illustrating a fluorescent lamp type LED lighting device according to another embodiment of the present disclosure.

FIG. 4 is a sectional view illustrating a fluorescent lamp type LED lighting device according to another embodiment of the present disclosure.

Referring to FIG. 4, the substrate 10 is installed not to be in contact with the upper portion of the cover part 30 but to be located in an inner space between the cover part 30 and the case part 20. The arrangement of the substrate 10 causes diffusion of light even in a space between the substrate 10 and the cover part 30. Further, the cover part 30 is not divided by the substrate 10, and light having the uniform illuminance can be emitted through the entirety of the cover part 30.

Figure 5:
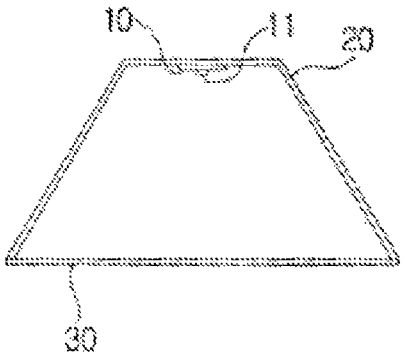

As another embodiment, as illustrated in FIG. 5, the substrate 10 can be arranged such that the light-emitting surface of the LEDs 11 faces the cover part 30.

Figure 6:
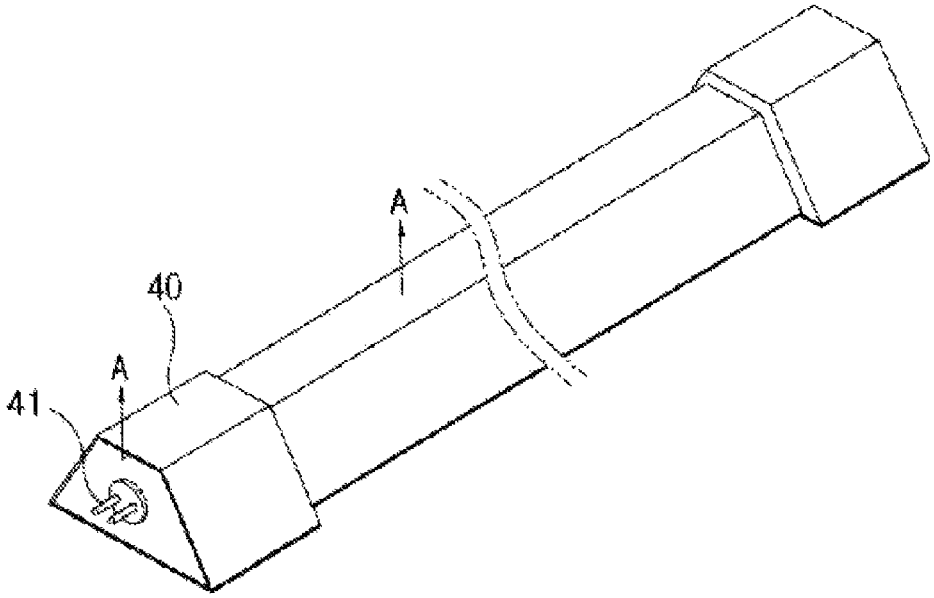
FIG. 6 is a perspective view illustrating a fluorescent lamp type LED lighting device according to another embodiment of the present disclosure.
Figure 7:
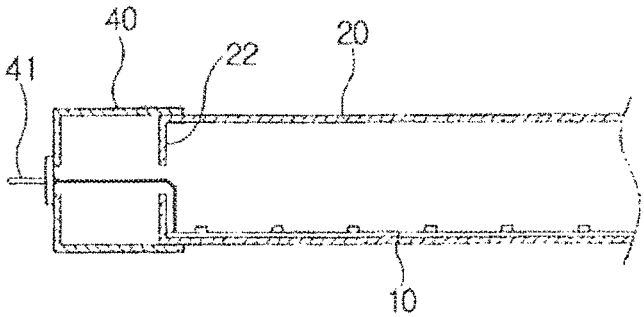
FIG. 7 is a sectional view taken along line A-A in FIG. 6.

FIG. 6 is a perspective view illustrating a fluorescent lamp type LED lighting device according to another embodiment of the present disclosure, and FIG. 7 is a sectional view taken along line A-A in FIG. 6.

Referring to FIG. 6, in a fluorescent lamp type LED lighting device according to another embodiment of the present disclosure, G13 socket parts 40 are fitted in opposite sides of the structure of the present disclosure as illustrated in FIG. 1 such that the fluorescent lamp type LED lighting device can be applied to an existing fluorescent light.

In order to receive Direct-Current (DC) power through protruding terminals 41 of the G13 socket part 40 to supply the DC power to the substrate 10, a through-hole is provided at a part of the finishing reflection surface 22 so that an electric wire connected to the terminals 41 can be connected to the substrate 10.

It is preferred that the inner surface of the G13 socket part 40 is also made of a resin material which can reflect light.

FIGS. 6 and 7 correspond to a structure which can be applied when a power supply unit for supplying DC power is located outside.

Figure 8:
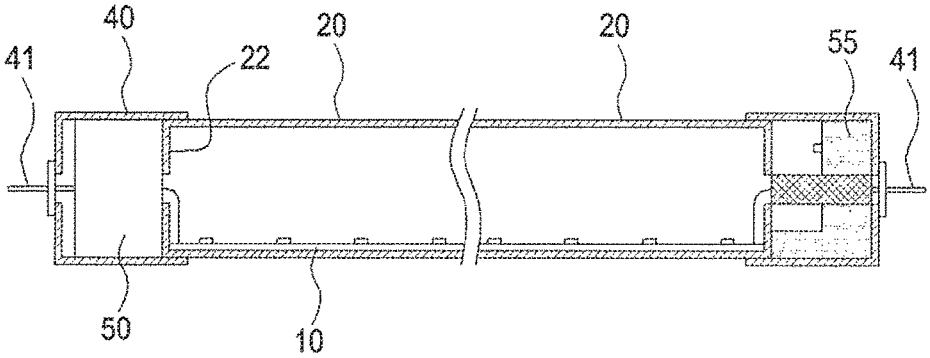
FIG. 8 is a sectional view illustrating a fluorescent lamp type LED lighting device according to another embodiment of the present disclosure.

FIG. 8 is a sectional view illustrating a fluorescent lamp type LED lighting device according to another embodiment of the present disclosure.

Referring to FIG. 8, a power supply unit 50 can be embedded inside the G13 socket part 40 in addition to the structure illustrated in FIG. 7, the structure of FIG. 8 is directly coupled to the existing fluorescent lighting device using Alternating Current (AC) power to receive AC power through the terminals 41, and the power supply unit 50 can convert the AC power into DC power to supply the converted DC power to the substrate 10.

In such a structure, the existing lighting device can be used continuously, thereby improving versatility.

Further, although FIG. 8 illustrates one side of the case part 20, the power supply unit 50 is embedded in opposite sides so as to supply electric power to opposite sides of the substrate 10. This structure can compensate for a voltage drop, considering that the voltage drop may occur when the length of the substrate 10, i.e., the length of the case part 20 of the present disclosure is longer than a predetermined length.

Figure 9:
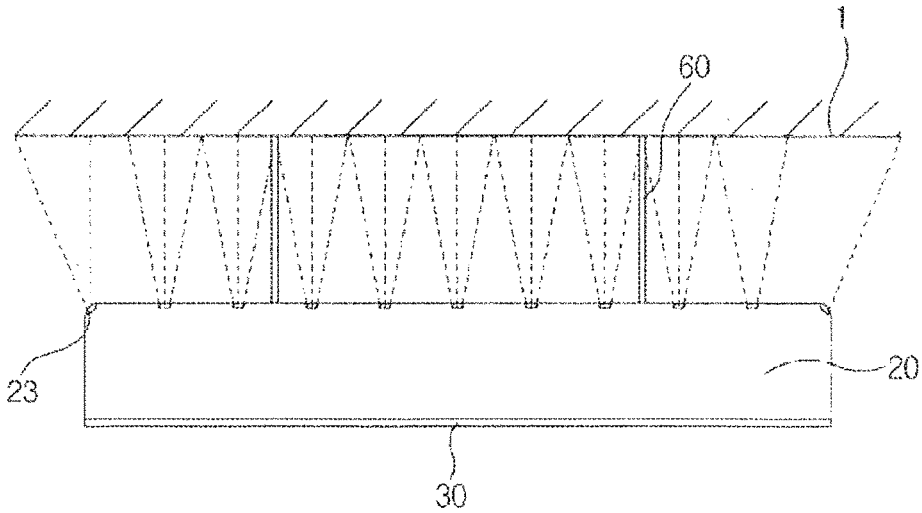
FIG. 9 illustrates an installation state of a fluorescent lamp type LED lighting device according to another embodiment of the present disclosure.

It is preferred that, when the power supply unit 50 is located only on one side of the G13 socket part 40, a counterweight 55 is installed on the other side of the G13 socket part in consideration of weight distribution between the one side and the other side. FIG. 9 illustrates an installation state of a fluorescent lamp type LED lighting device according to another embodiment of the present disclosure, FIG. 10 is a partially perspective view of the present disclosure illustrated in FIG. 9, and FIG. 11 is a sectional view taken along line A-A in FIG. 10.

Figure 10:
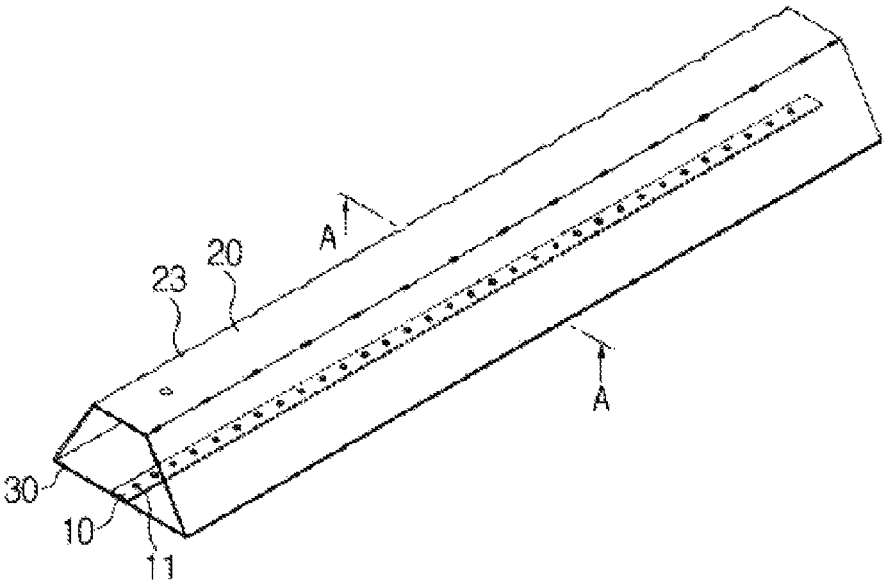
FIG. 10 is a partially perspective view of the present disclosure illustrated in FIG. 9.
Figure 11:
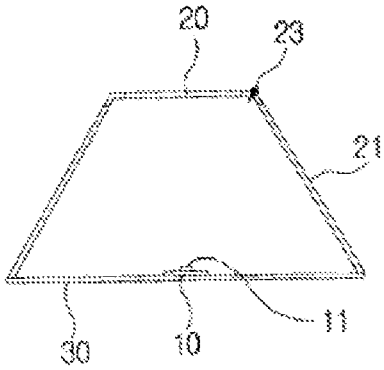
FIG. 11 is a sectional view taken along line A-A in FIG. 10.

Referring to FIGS. 9 to 11, a fluorescent lamp type lighting device according to another embodiment of the present disclosure is not embedded and installed in a ceiling, the case part 20 is fixed by a raising/lowering part 60 which can adjust the height from the ceiling 1, and the fluorescent lamp type lighting device can be vertically moved by the raising/lowering part 60.

Such a structure may be applied on the upper side of a table, the upper side of a desk, etc., that is, when it is required to adjust the height of a lighting device as needed. The raising/lowering part 60 may be manual or motor-operated, and the present disclosure is not limited by the structure or a height adjustment scheme.

In the above structure, the case part 20 may further includes a light emitting hole 23 for emitting light of the LEDs 11 from the interior of the case part 20 to the ceiling 1 in a reflected and diffused process.

The light-emitting hole 23 may be made of a transparent material or a semi-transparent material which reflects some of the light and transmits some of the light.

The light emitting hole 23 may be individually separated as illustrated in the drawing and may be linearly provided along the circumference of the case part 20.

In this way, light is emitted through the light emitting hole 23 to the ceiling 1, so that a dark zone is not generated on the ceiling 1.

Figure 12:
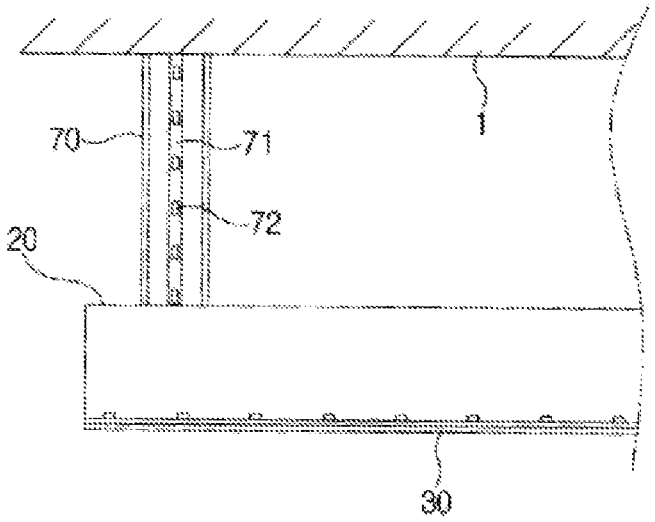
FIG. 12 illustrates a part of a fluorescent lamp type LED lighting device according to another embodiment of the present disclosure.

FIG. 12 illustrates a part of a fluorescent lamp type LED lighting device according to another embodiment of the present disclosure.

Referring to FIG. 12, a fluorescent lamp type LED lighting device according to another embodiment of the present disclosure may be fixedly installed at a location which is spaced apart from the ceiling 1. At this time, a connection tube 70 may be provided between the ceiling 1 and the case part 20. The connection tube 70 is a tube for transmitting or diffusing light, and has a separate substrate 71 and LEDs 72 mounted to the substrate 71, which are provided therein.

At this time, light of the LEDs 72 penetrates the connection tube 70 or is diffused in the connection tube 70, to be surface-emitted so as to illuminate the ceiling 1. Therefore, a dark zone is prevented from being generated on the ceiling 1.

Figure 13:
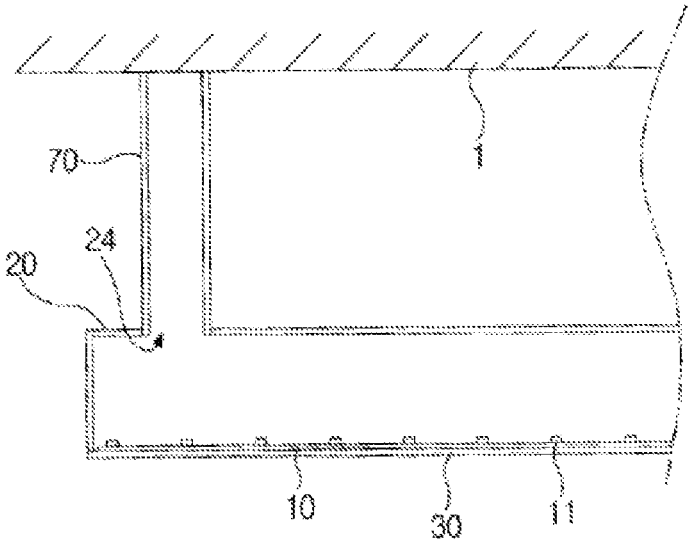
FIG. 13 is a sectional view illustrating an installation state of a fluorescent lamp type LED lighting device according to another embodiment of the present disclosure.

FIG. 13 is a sectional view illustrating an installation state of a fluorescent lamp type LED lighting device according to another embodiment of the present disclosure.

Referring to FIG. 13, a fluorescent lamp type LED lighting device according to another embodiment of the present disclosure has the same configuration, in which the case part 20 is connected to the ceiling 1 through the connection tube 70, as that of the embodiment of FIG. 12.

However, a through hole 24 is formed at a portion of the case part 20, at which the case part 20 and the connection tube 70 are connected to each other, and light of the LEDs 11 reflected and diffused from the case part 20 is reflected to the interior of the connection tube 70 and is emitted to the outside through the connection tube 70 which transmits or diffuses the light to emit the light.

That is, light is emitted through the connection tube 70 without using separate LEDs 72 as in FIG. 12, so that a dark zone is prevented from being generated on the ceiling 1.

In this way, the present disclosure may have various embodiments, and may be implemented in variously changed forms according to an object and need of a light.

Figure 14:
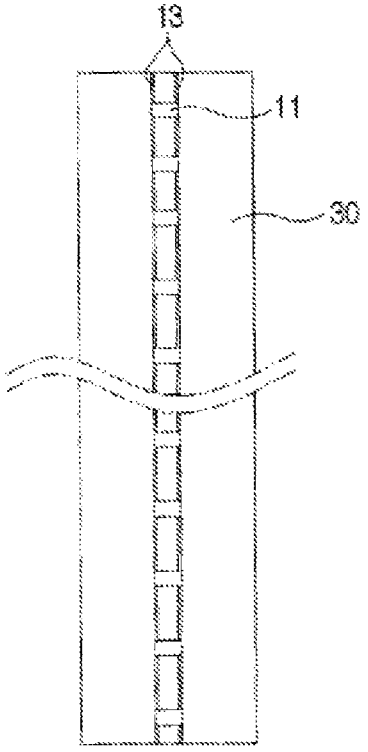
FIG. 14 illustrates a part of a fluorescent lamp type LED lighting device according to another embodiment of the present disclosure.

FIG. 14 illustrates a part of a fluorescent lamp type LED lighting device according to another embodiment of the present disclosure.

Referring to FIG. 14, in a fluorescent lamp type LED lighting device according to another embodiment of the present disclosure, a pair of metal electrode patterns 13 can be formed on a cover part 30, and LEDs 11 can be mounted on the metal electrode pattern 13.

When a process scheme can form the metal electrode pattern 13 on the resin-made cover part 30 by a low temperature process, the present disclosure is not limited by the process scheme. The metal electrode pattern 13 can be formed by schemes such as printing of a paste, laser processing, and sputtering.

By forming the metal electrode pattern 13, the substrate 10 is not used, the resin-made cover part 30 can serve as the substrate, the number of components is reduced, and manufacturing costs are reduced.

Further, since the metal electrode pattern 13 can be formed in a desired shape, various patterns can be achieved.

For example, when the metal electrode pattern is formed in a traditional window pattern, an indoor atmosphere can be variously configured by providing different lighting.

Such a metal electrode pattern 13 can be applied to all of the above-described embodiments of the present disclosure.

Further, the metal electrode pattern 13 may be a transparent electrode such as an ITO. At this time, the present invention can be implemented such that complete surface emitting can be performed on the outside by displaying only a dot-shaped LED 11 or by not displaying a small LED 11 on a light-exiting surface by diffraction of light.

Further, as it is known, the LED 11, which can vary a color temperature using various colors and by adjusting a color sense of the same color, can easily provide illumination having more various colors and color temperatures, thereby achieving various indoor atmospheres.

Figure 15:
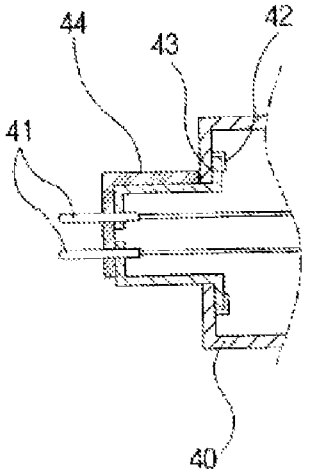
FIG. 15 is a partially sectional view illustrating another embodiment of the present disclosure.
Figure 16:
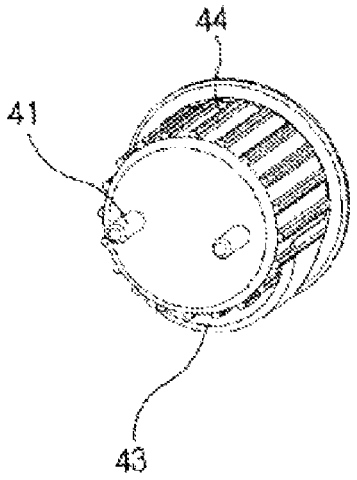
FIG. 16 is a perspective view illustrating an outer appearance of FIG. 15.

FIG. 15 is a partially sectional view illustrating another embodiment of the present disclosure, and FIG. 16 is a perspective view illustrating an outer appearance of FIG. 15.

Referring to FIGS. 15 and 16, the G13 socket part 40 includes a rotation support part 42 fixed to the inside of the side surface of the G13 socket part 40, an inner rotation part 43 having one end rotatably fixed to the rotation support part 42 and protruding toward the outside of the side surface of the G13 socket part 40 in a state in which the terminals 41 are fixed to the other end thereof, and an outer rotation part 44 which is fastened to the entirety or a part of the outside of the inner rotation part 43 and has a protrusion formed on the side surface thereof, thereby making rotation easy.

According to such a configuration, the terminals 41 can rotate within a predetermined angle range so as to be easily coupled to and separated from the existing fluorescent lamp lighting device.

Figure 17:
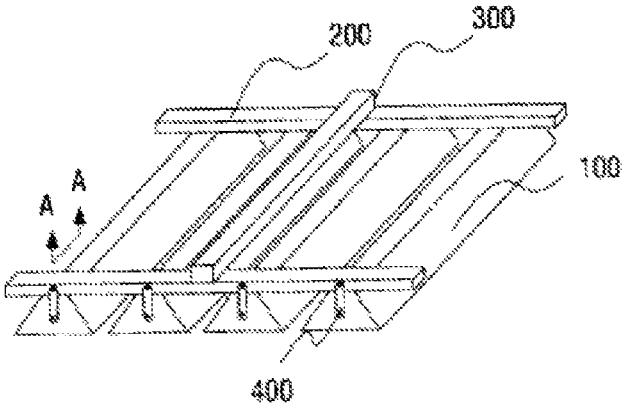
FIG. 17 illustrates an installation state of a fluorescent lamp type LED lighting device according to another embodiment of the present disclosure.

The above-described configuration corresponds to one embodiment, and when a structure can rotate the terminals 41 to be easily coupled to the existing fluorescent lamp lighting device, the structure can be applied to the G13 socket part 40. FIG. 17 illustrates an installation state of a fluorescent lamp type LED lighting device according to another embodiment of the present disclosure, FIG. 18 is a sectional view taken along line A-A in FIG. 17, and FIG. 19 illustrates a part of a side surface of the installation state illustrated in FIG. 17 for describing the operation.

Figure 18:
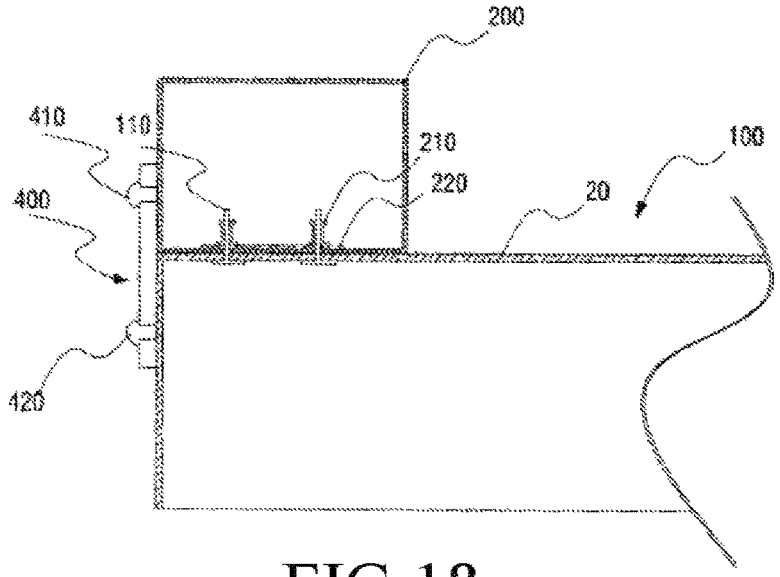
FIG. 18 is a sectional view taken along line A-A in FIG. 17.
Figure 19:
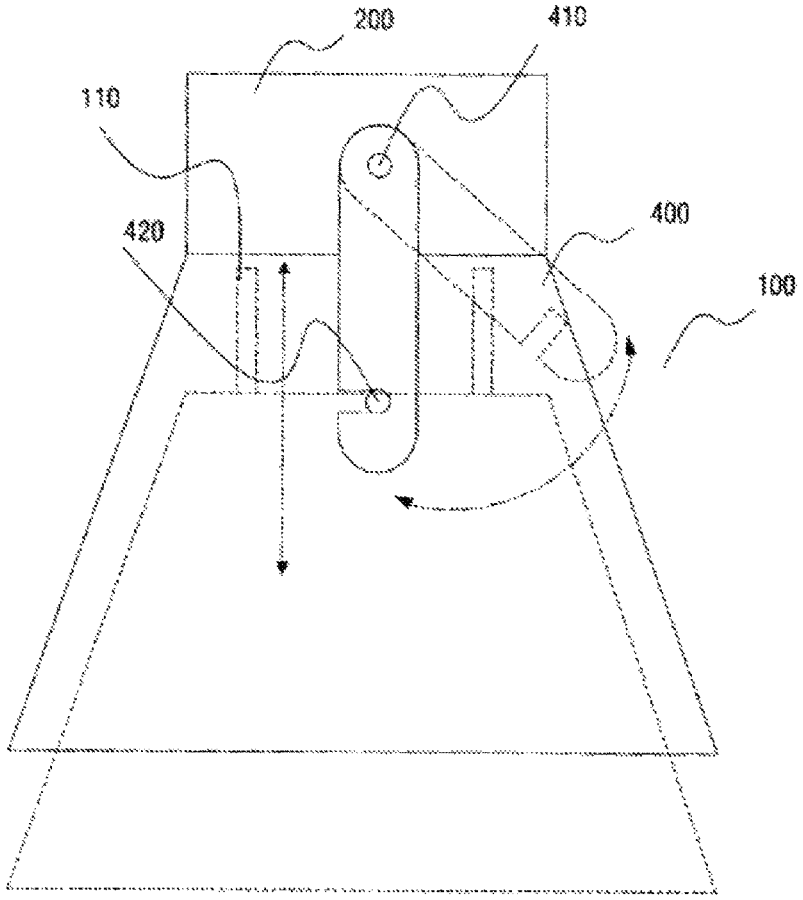
FIG. 19 illustrates a part of a side surface of the installation state illustrated in FIG. 17 for describing the operation.

Referring to FIGS. 17 to 19, a plurality of fluorescent lamp type LED lighting devices 100 according to another embodiment of the present disclosure may be fixedly installed on the bottom surface of opposite ends of a pair of support frames 200 having a socket part 210 provided on the bottom surface thereof. That is, in the fluorescent lamp type LED lighting device, case parts 20 of the plurality of fluorescent lamp type LED lighting devices 100 are fixedly installed in a different scheme without using the G13 socket part 40 of the above embodiment, so as to supply electric power.

At this time, rotation fixing parts 400, which are coupled to fixing protrusion parts 420 provided at opposite ends of the fluorescent lamp type LED lighting device 100 by rotating about a rotary shaft part 410, such that the fluorescent lamp type LED lighting device 100 is fixed to be easily detachable, are provided on the side surface of the outside of the pair of support frames 200 such that each of the fluorescent lamp type LED lighting devices 100 is easily replaced.

The rotation fixing part 400 is a plate-shaped structure, can rotate in a state in which a location thereof is fixed by the rotary shaft part 410, and has a groove provided therein and cut in the rotation direction such that the fixing protrusion part 420 is inserted in the cut groove, thereby coupling and fixing the case part 20 of the fluorescent lamp type LED lighting device 100 to the support frame 200.

A protruding plug 110 is provided at a portion of the fluorescent lamp type LED lighting device 100, which is in contact with the support frame 200, the plug 110 is inserted into the socket part 210 provided in the support frame 200 to receive electric power, and an electric wire is connected to the plug 110 to supply electric power to the substrate 10.

The socket part 210 is preferably configured in a shape having a resilient restoring force with regard to the side surface of the plug 110 such that the plug does not easily escape therefrom and electric power can be stably supplied.

Further, as illustrated in FIG. 19, the fluorescent lamp type LED lighting device 100 can be easily attached/detached by the rotation fixing part 400. The plurality of fluorescent lamp type LED lighting devices 100 are fixed to the support frame 200 by the rotation fixing part 400 as needed, so that a lighting device having illumination which accords with a usage object is provided and a damaged fluorescent lamp type LED lighting device can be easily replaced and then used.

Not-described reference numeral 300 denotes a fixing frame for connection and fixing a part of the upper portion of the pair of support frames 200. A wire, which can install the fixing frame 300 on the ceiling or other locations, may be provided in the fixing frame 300, and although omitted in the drawing, a power supply unit for receiving an input of external AC power, converting the received AC power into DC power, and supplying electric power to the socket part 210 through a substrate 220 provided on at least one of the pair of support frames 200 may be provided.

According to such a configuration, the present disclosure can advantageously replace, one by one, the fluorescent lamp type LED lighting device 100 which is easily attached/detached and is required to be replaced, and reduce maintenance and management costs.

It will be apparent to those skilled in the art to which the present disclosure pertains that the present disclosure is not limited to the above embodiments and may be variously modified and changed without departing from the technical spirit of the present disclosure.

A fluorescent lamp type lighting device according to the present disclosure can allow light of an LED to be emitted toward the indoor ceiling and provide a reflection space, by which the emitted light of the LED is reflected and diffused, so as to emit the light through the bottom surface, thereby improving light efficiency because a separate diffusion plate for surface emitting is not used.

Further, the present disclosure can provide a lighting device which has a Direct-Current (DC) power supply unit provided therein or the DC power supply unit provided on the existing lighting device, thereby achieving lower power consumption and uniform illumination without changing a pre-installed lighting apparatus.

Further, the present disclosure can be easily applied to the existing embedded-type fluorescent lighting device or the existing pedant-type fluorescent lighting device so as to improving versatility, and induce some beams of light to be emitted to the ceiling so as to prevent a dark zone from being generated.

In addition, the present disclosure can provide a resin-made fluorescent lamp type LED lighting device, thereby improving storability and transportability and preventing damage to a human body resulting from breakage thereof, as compared with the existing glass-made fluorescent light.

What is claimed is:

1. A fluorescent lamp type LED lighting device comprising:

a case part which is formed to be elongated in one direction and has a reflection space formed therein, wherein a bottom surface of the case part is open;

a cover part which is provided on the bottom surface of the case part and is transparent; and a plurality of LEDs which are arranged in the one direction on the cover part, and emit the light toward the case part, wherein the light emitted by the LEDs is reflected and diffused inside the case part, and the light transmits the cover part, wherein G13 socket parts are coupled to opposite ends of the case part to be coupled to a fluorescent lamp fixture, and wherein, when a power supply unit is located in only one of the G13 socket parts, a counterweight is mounted to the other G13 socket part.

2. The fluorescent lamp type LED lighting device of claim 1, wherein the case part has opposite sides bent along a lengthwise direction, and a bent interior angle is an obtuse angle.

3. The fluorescent lamp type LED lighting device of claim 1, wherein the LEDs are in contact with an upper side of the cover part or are mounted to a substrate fixed at a spaced location.

4. The fluorescent lamp type LED lighting device of claim 1, wherein the LEDs receive electric power while being mounted to a metal electrode pattern formed to be in contact with an upper side of the cover part.

5. The fluorescent lamp type LED lighting device of claim 1, wherein a power supply unit for supplying Direct Current (DC) power is mounted to an interior of at least one of the G13 socket parts.

6. The fluorescent lamp type LED lighting device of claim 1, wherein the G13 socket parts include terminals coupled to the fluorescent lamp fixture, and the terminals are rotatable.

7. The fluorescent lamp type LED lighting device of claim 1, wherein a light emitting hole for emitting light is provided on an upper circumference of the case part.

8. The fluorescent lamp type LED lighting device of claim 1, wherein the case part is fixedly installed on a ceiling by a connection tube, and the ceiling is illuminated through the connection tube.

9. The fluorescent lamp type LED lighting device of claim 8, wherein a through-hole communicating with the connection tube is provided in the case part, so that light of the LEDs is emitted through the connection tube.

10. A fluorescent lamp type LED lighting device comprising:

a case part which is formed to be elongated in one direction and has a reflection space formed therein, wherein a bottom surface of the case part is open;

a cover part which is provided on the bottom surface of the case part and through which, light reflected and diffused inside the case part, is emitted;

a plurality of LEDs which emit light from an interior of the cover part and the case part to reflect and diffuse the light inside the case part; and a pair of support frames to which upper opposite ends of a plurality of case parts are coupled, wherein rotation coupling parts are provided outside the pair of support frames such that the case part is easily attached/detached.

11. The fluorescent lamp type LED lighting device of claim 10, wherein the rotation coupling parts are rotatable in a state in which locations of the rotation coupling parts are fixed by rotary shaft parts provided on side surfaces of the support frames and have cut grooves in which fixing protrusion parts provided on opposite ends of the case part are fitted.

12. The fluorescent lamp type LED lighting device of claim 11, wherein the support frames have socket parts for supplying electric power, and a plug connected to the substrate protrudes from an upper portion of the support frame, so that electric power is supplied to the substrate by coupling between the support frame and the case part.

* * * * *